US005222529A

United States Patent [19]

Zoltan et al.

[11] Patent Number: 5,222,529

[45] Date of Patent: Jun. 29, 1993

[54] FILLING APPARATUS

[75] Inventors: Bart J. Zoltan, Old Tappan, N.J.; William F. Boulay, West Haverstraw, N.Y.; Donald R. Miller, Westwood, N.J.

[73] Assignee: American Cyanamid Company, Stamford, Conn.

[21] Appl. No.: 970,441

[22] Filed: Oct. 30, 1992

Related U.S. Application Data

[63] Continuation of Ser. No. 632,458, Dec. 21, 1990.

[51] Int. Cl.[5] ..... B65B 31/00

[52] U.S. Cl. ..... 141/4; 141/5; 141/67; 141/249; 137/888; 406/153; 406/146

[58] Field of Search ..... 141/1, 4, 5, 67, 249, 141/46; 137/205.5, 564.5, 888; 417/86, 88; 222/630, 637; 406/146, 142, 153, 171; 128/203.15

[56] References Cited

U.S. PATENT DOCUMENTS

| | | | |
|---|---|---|---|
| 2,795,460 | 6/1957 | Bletcher et al. | 137/564.5 |
| 3,162,332 | 12/1964 | Hayim | 222/630 |
| 3,225,759 | 12/1965 | Drapen et al. | 137/564.5 |
| 3,656,517 | 4/1972 | Taylor et al. | 141/1 |
| 3,785,568 | 1/1974 | Pfingsten et al. | 406/142 |
| 3,859,996 | 1/1975 | Mizzy et al. | 141/67 |
| 4,133,281 | 1/1979 | Holmes et al. | 141/1 |
| 4,186,772 | 2/1980 | Handleman | 406/153 |
| 4,191,223 | 3/1980 | Burgeois | 141/67 |
| 4,193,520 | 3/1980 | Duffield | 222/630 |
| 4,411,389 | 10/1983 | Harrison | 406/153 |
| 4,721,126 | 1/1988 | Horii | 137/888 |
| 4,872,493 | 10/1989 | Everman | 141/67 |
| 4,974,634 | 12/1990 | Agulia | 137/564.5 |

*Primary Examiner*—Henry J. Recla
*Assistant Examiner*—Steven O. Douglas
*Attorney, Agent, or Firm*—Thomas S. Szatkowski

[57] ABSTRACT

An apparatus for filling finely powdered material into a long and narrow cavity or hole having a relatively small opening is provided. The apparatus features a discharge port for a particulate laden gas stream directed toward the opening of the hole to be filled but spaced apart from the opening of the cavity to be filled by a gap, so that in operation the powdered material continues across the gap and into the cavity due to its inertia while the gas escapes through the gap.

18 Claims, 8 Drawing Sheets

FILLING APPARATUS

This is a continuation of co-pending application Ser. No. 07/632,458 filed on Dec. 21, 1990.

BACKGROUND OF THE INVENTION

1. Field of the Invention

The invention relates to a filling apparatus, particularly an apparatus for filling a finely powdered material into a long and narrow cavity or hole having a relatively small opening.

2. Description of Prior Art

It is desirable to administer a pharmacologically active material in a finely powdered form to a patient. For example, anti-ashma and other drugs have been administered via oral inhalation type dispensing devices. One problem with administering finely powdered materials is that it is often necessary to accurately and repeatably fill long and narrow cavities or holes that comprise the dispensing apparatus with a measured unit dosage amount of the material.

In this regard, recently, an apparatus and method for dispensing a finely powdered solid antibiotic therapeutic agent into the periodontal pocket of a patient suffering from periodontal disease has been developed (U.S. Ser. Nos. 054,372, 288,739, 289,076 and Ser. No. 593,125. The apparatus includes a narrow tip portion sufficiently small to fit into the periodontal pocket. The powdered therapeutic agent is disposed within a narrow bore located in the tip and dispensed from the tip into the periodontal pocket.

Filling the narrow bore of the periodontal dispensing apparatus with the proper amount of the powdered therapeutic agent has proved to be a difficult task due to the small opening through which the agent must enter and the relatively long and narrow hole which must be filled. In addition, due to the fact that a standard dosage of the therapeutic agent must be delivered to the periodontal pocket, the dispensing apparatus must be filled in a precise and repeatable manner.

One known way of filling a cylinder such as a cartridge with a powdered material such as gun powder involves placing the gun powder in a funnel and allowing gravity to feed it through the funnel stem into the cartridge. This method would not be useful to fill the periodontal dispensing apparatus described above because the hole to be filled is too narrow to allow particles to flow through by gravity feed. In addition, the therapeutic agent is hydroscopic and does not flow evenly.

Another way to fill a long and narrow hole such as the bore in the periodontal dispensing apparatus includes gathering a mound of the powder, and tamping the bore repeatedly into the mound, until the desired weight of medication has been added to the weight of the dispenser. This method, however, is extremely time consuming and inaccurate.

It is thus an object of the present invention to provide an apparatus capable of filling a long and narrow cavity or hole having a relatively small opening with a finely powdered material. It is another object of the invention to provide an apparatus capable of accurately filling a long and narrow hole or cavity of an apparatus for dispensing such material with a unit dosage amount of a pharmacologically active powdered material.

SUMMARY OF THE INVENTION

The invention provides a filling apparatus for dispensing and filling a finely powdered material into a long and narrow cavity or hole having a relatively small opening which apparatus includes a discharge port having an orifice positioned so as to point at the opening of the cavity to be filled, but spaced apart from the opening of the cavity or hole by a gap, means for suspending the finely powdered material into a moving gas stream and discharging the gas stream through the orifice of the discharge port, whereby as the gas stream containing the suspended powdered material is discharged through the orifice of the discharge port the powder bridges the gap and fills the hole or cavity while the gas escapes through the gap. The gap between the discharge port and the opening of the cavity or hole to be filled should be a distance not greater than twice the size of the orifice of the discharge port, preferably a distance of about 0.2 to 2 times the size of the orifice of the discharge port. Since the density of the powder is typically much greater than that of the gas, the gas can easily change direction and escape through the gap, however, the powder which is denser, continues because of its inertia into the long and narrow cavity or hole. For the cavity or hole to be filled, the far end of the hole must be blocked. In the event that devices such as a small pipe or tube are to be filled, the far end can be temporarily blocked until the filling is complete. When the hole is filled to capacity the excess powder automatically exits through the gap, and may be reclaimed for use, if desired. In the case of the present invention the powder is reclaimed because the powder is a pharmaceutical product which is valuable, and which must be accounted for.

DESCRIPTION OF THE PREFERRED EMBODIMENTS

Figure 1:
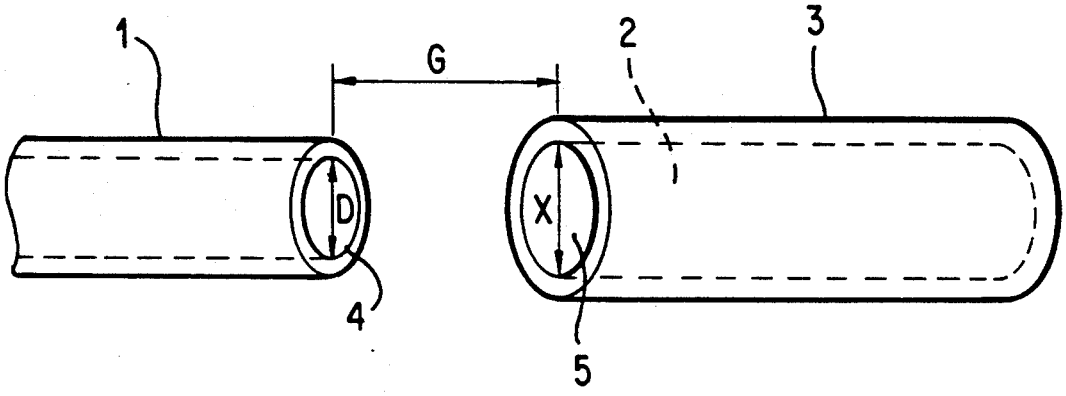
FIG. 1 depicts the discharge port, gap and the cavity or hole to be filled.

The filling apparatus of the present invention is particularly suited for filling a long and narrow cavity or hole having a relatively small opening with a finely powdered material. For this invention narrow is considered to be about 1 millimeter in width or diameter or smaller, and long is considered greater than about seven millimeters in length. The cavity or hole to be filled may be of any cross sectional shape and may for example include square, rectangular, spherical, or an irregular shape. The hole need not have a uniform cross section. For this invention, a relatively small opening is considered to be about 1 millimeter in width or diameter or smaller. As with the cavity or hole the opening may be of various shapes.

The invention is particularly suited for filling various dispensing devices for dispensing unit dosage forms of pharmacologically active materials. In this regard, it is recognized that the material must be packed into the cavity of the dispensing device in such a way so that it can be dispensed therefrom. The apparatus of the present invention is uniquely suited for this type of filling in that the powdered materials are not packed too tightly due to the fact that they are transported via a moving gas stream. Further in this regard, it will be appreciated that cylindrical cavities are particularly suited to be filled by the present apparatus because cylindrical barrels and cylindrical plungers provide reproducible cross sections and volumes for dispensing. Also, cylindrical plungers are well suited to dispense all of the material without leaving any behind in corners, etc. In the event that a cavity has more than one opening, all but one must be temporarily blocked during the filling operation or otherwise the particle laden gas stream will exit through the other openings and the cavity will not be filled. This temporary blocking can be easily removed and thus items such as small tubes or pipes are filled.

The filling apparatus of the present invention is particularly suited for filling all types of finely powdered solid materials such as pharmacologically active powdered materials. Among the pharmacologically active agents which can be finely powdered and thus are amenable for filling by the present apparatus are peptides and proteins. Specific examples of the latter are: aerial natriuretic factor, tumor necrosis factor, oxytocin, vasopressin, adrenocorticotropic hormone (ACTH), epidemial growth factor, tryocidins, gramicidins, renin, bradykinin, angiotensins, enctorphins, enkephalins, calcitonin, salmon calcitonin, secretin, calcitonin gene related factor, tissue plasminogen factor, kidney plasminogen factor, cholecystokinin, melanocyte inhibiting factor, melanocyte stimulating hormone, neuropeptide y, nerve growth factor, muramyl dipeptide, thymopoietin, human growth hormone, porcine growth hormone, sodium pentemedine, bovine growth hormone, insulin, thyrotropin releasing hormone (TRH), arogastrone, pentagastrin, tetragastrin, gastrin, interferons, glucagon, somatostatin, prolactin, superoxide dismutose, luteinizing hormone releasing hormone(LHRH), H-5-Oxo-Pro-His-Trp-Ser-Tyr-DTrp-Leu-Arg-Pro-Gly-$NH_2$, H-5-Oxo-Pro-His-Trp-Ser-Tyr-3-(2Napthyl)-D-alanyl-Leu-Arg-Pro-Gly-$NH_2$, Luteinizing hormone-releasing factor (pig), 6-[0-(1,1-dimethylethyl)-D-serine]-10-deglycinamide-, 2-(aminocarbonyl)hydrazide (9CI), Luteinizing hormone-releasing factor (pig), 6-[0-(1,1-dimethylethyl)-D-serine]-9-[N-ethyl-L-prolinamide)-10-deglycinamide(9CI), Luteinizing hormone-releasing factor (pig), 6-D-leucine-9-(N-ethyl-L-prolinamide)-10-deglycinamide-(9CI) and synthetic analogs and modifications and pharmacologically active fragments thereof and pharmaceutically acceptable salts thereof.

Other classes of compounds suitable for filling via the present apparatus includes: penicillins, betalactamase inhibitors, cephalosporins, quinolones, aminoglycoside antibiotics (gentamicin, tobramycin, kanamycin, amikacin), estradiol, norethisterone, norethindrone, progesterone, testosterone, amcinonide, achromycin, tetracyclines (doxycycline, minocycline, oxytetracycline, tetracycline, chlortetracycline, demeclocycline, methacycline), clindamycin, Vitamin B-12, anesthetics (procaine, tetracaine, lidocaine, mepivacaine, etidocaine), mitoxantrone, bisantrene, doxorubicin, mitomycin C, bleomycin, vinblastine, vincristine, cytosine arabinoside, ARA-AC, actinomycin D, daunomycin, daunomycin benzoylhydrazone, nitrogen mustards, 5-azacytidine, calcium leucovorin, cis-platinum compounds, 5-fluorouracil, methotrexate, aminopterin, maytansine, melphalan, mecaptopurines, methyl CCNU, hexamethylmelamine, etoposide, hydroxyurea, levamisole, mitoquanzone, misonidazole, pentostatin, teniposide, thioquanine, dichloromethotrexate, chloprothixene, molindone, loxapine, haloperidol, chlorpromazine, triflupromazine, mesoridazine, thioridazine, fluphenazine, perphenazine, trifluoperazine, thiothixene, and pharmaceutically acceptable salts of the foregoing, hydromorphone, oxymorphone, levorphenol, hydrocodone, oxcodone, nalophine, naloxone, naltrexone, buprenorphine, butorphenol, nalbuphine, mepridine, alphaprodine, anileridine, dipenoxylate, fentanyl and pharmaceutically acceptable salts of the foregoing. The foregoing may be utilized in finely powdered form, having sizes of from about 0.5 micron or larger. However, it will be appreciated that the materials may not be of such a large size to prevent suspension in a moving gas stream. In addition, useful materials include those microencapsulated pharmaceutical products of the type described in Ser. No. 054,372, the contents of which are incorporated by reference. Other suitable materials include these described in Ser. No. 288,739 and Ser. No. 289,076. These microencapsulated materials typically have sizes of 20 to 120 micron diameter, which are suitable for filling with the present apparatus.

It will be appreciated that the type of gas which is used to suspend the particles of solid material must be compatible with the material and in the case of pharmaceutical products must meet sanitary requirements. In this regard, and bearing in mind the compatibility and sanitary requirements it is contemplated that a wide variety of gasses may be employed, including, air, nitrogen, dry air, carbon dioxide, argon and other inert gasses. Dry air or nitrogen will be preferred in connection with hydroscopic or hydrophillic particles.

Referring to FIG. 1, discharge port 1 having orifice 4 with a width or diameter D is positioned so as to point at opening 5 of dispensing device 3 having cavity 2. Opening 5 has a width or diameter X. The discharge port 1 is spaced apart from the opening 5 of the cavity 2 by a gap G. The width or diameter D of orifice 4 of the discharge port must be equal to or smaller than the width or diameter X of opening 5 of cavity 2 to be filled. In some instances such as for discharge ports orifices or cavity openings with irregular or different shapes, it will be desirable for the discharge port to fit within the cavity opening. If the width or diameter of orifice 4 of the discharge port exceeds that of the width or diameter X of cavity 2, much of the particulate material suspended in the gas stream will flow by the side of the device 3 and will thus not enter cavity 2. The orifice 4 of discharge port 1 and opening 5 of device 3 are spaced apart by a distance identified as gap G. It has been found that a gap of not greater than 2 times the width or diameter D of orifice 4 fits this criterion. It is preferred that gap G be a distance of 0.2 to 2 times the width or diameter D. The size of the gap G must be sufficiently large so that gas will be allowed to escape but not so large that the particulate material will not be carried along in the gas stream and bridge the gap.

Figure 2:
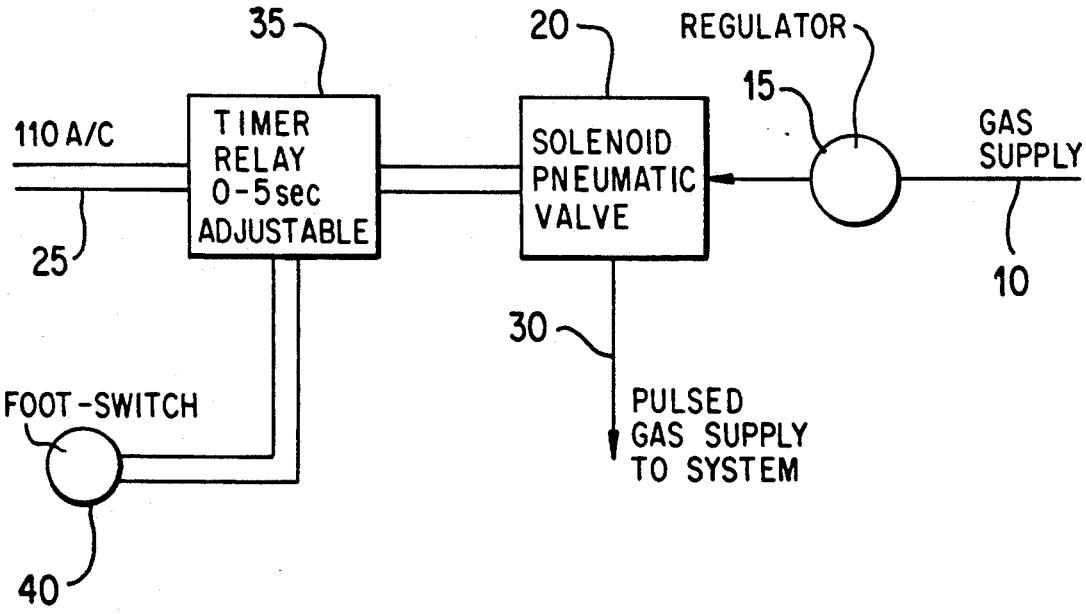
FIG. 2 is a block diagram of the control elements of the system.
Figure 3:
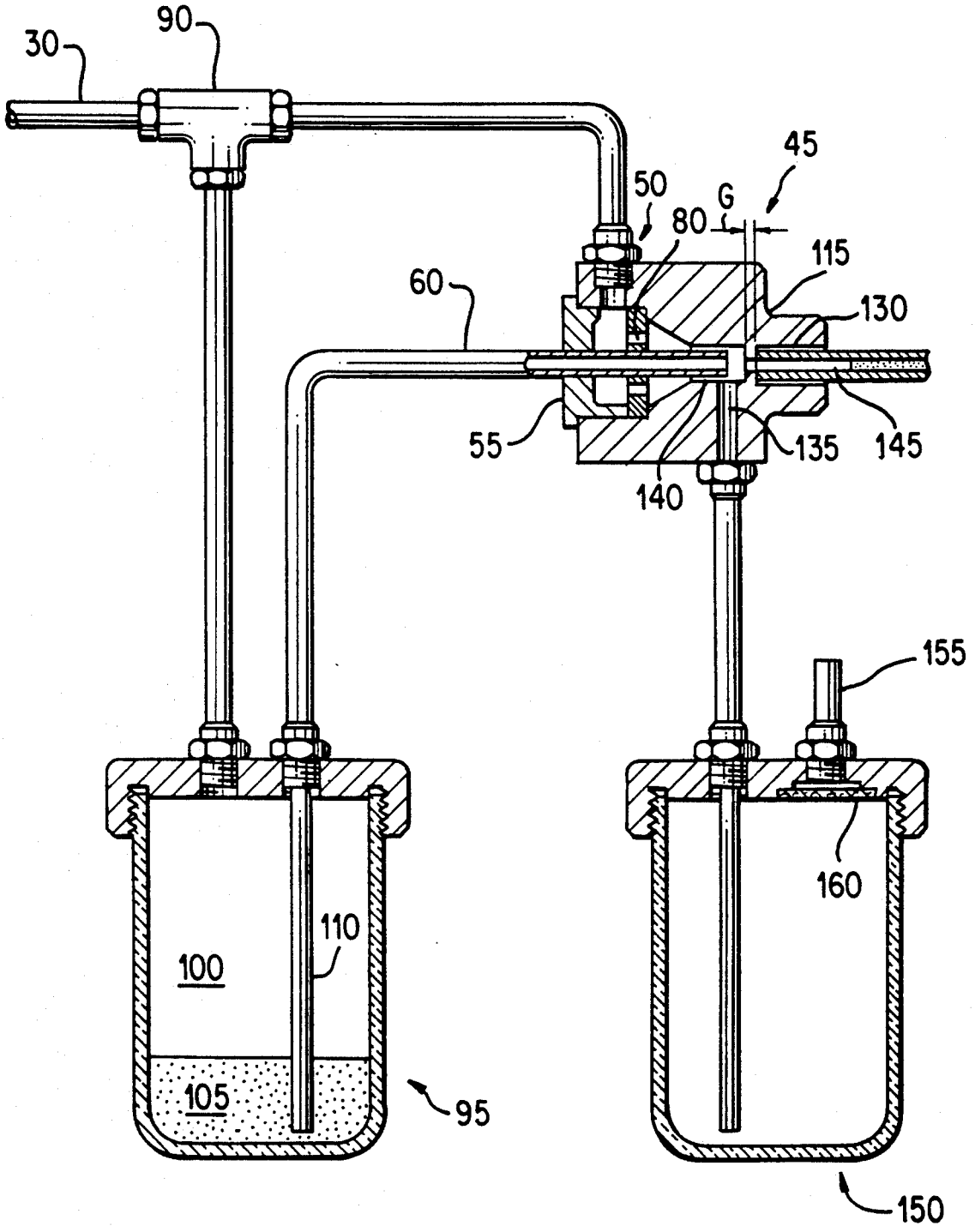
FIG. 3 depicts one embodiment of a filling apparatus according to the present invention.
Figure 4:
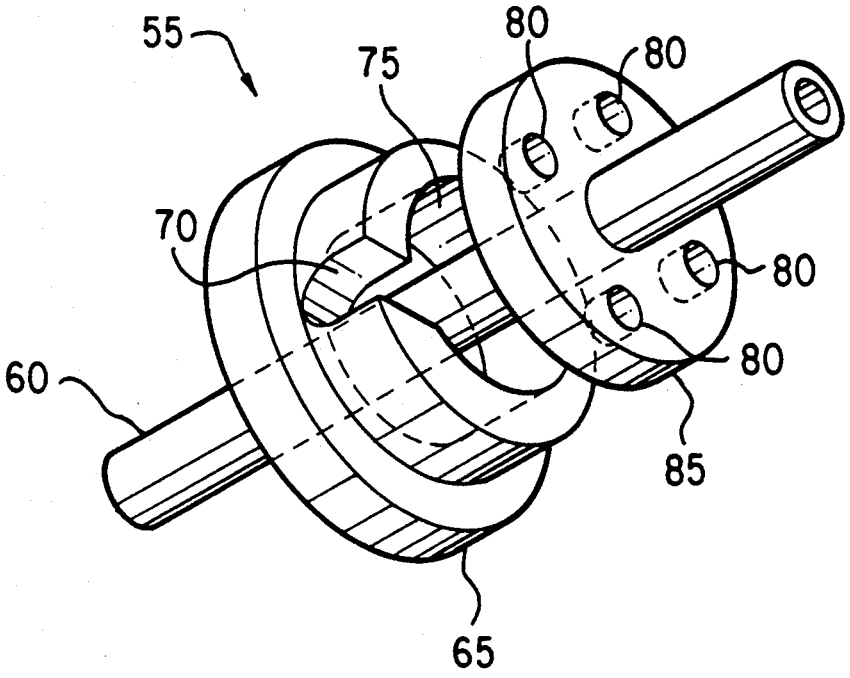
FIG. 4 is a detailed view of the manifold of the nozzle assembly.

In the embodiment of the apparatus described herein with reference to FIGS. 2–4, the discharge port orifice has a diameter of 0.038 inches and the gap is 0.010 inches.

It will be appreciated that the powdered material may be suspended in a moving gas stream by any number of devices such as the venturi device described in greater detail herein or a fluidized bed or any other device which results in suspending particles of material in a moving stream of gas. The particular device must be capable however of suspending a sufficient amount of particles to fill the required cavities quickly and efficiently but not to allow too many particles to become suspended else they clog the discharge port or the gap. In this regard, for example, the flow rate of the gas through a device such as a venturi may be regulated to maintain a proper suspension of particles in the gas stream.

In one embodiment the filling apparatus includes a container for holding the powdered material to be filled, a source of gas (preferably dry air, or nitrogen), a regulator to provide the required volumetric flow rate, a venturi nozzle assembly for discharging the gas and drawing up the powder into the stream of discharged gas. Optionally it may also have an overflow collector for trapping powder which was in excess of the volume required to fill the narrow bore hole.

Referring to FIG. 2, a supply of gas 10 is regulated by a regulator 15 prior to being connected to a solenoid controlled pneumatic valve 20. When the pneumatic valve 20 is energized by a standard 115 volt source 25, a solenoid controlled valve opens, permitting the gas to flow through pipe 30 to the filling system. Because for the operation of this invention only a brief burst of gas is required, an adjustable timer relay 35 is set to limit the time duration of the opening of the solenoid controlled pneumatic valve to under one second. It is not a requirement that the gas supply be pulsed, but it is preferred, to avoid packing of the finely powdered material. The closing of the timer relay 35 is initiated by the activation of a footswitch closure of switch 40.

The filling system is shown in greater detail in FIG. 3. The gas supply to the system 30 is shown in both FIGS. 1 and 2. The gas supply is connected to the venturi nozzle assembly 45 using a standard pneumatic connector 50. In the venturi nozzle assembly 45, the gas enters a manifold 55 which is shown both in FIGS. 3 and 4. Referring to FIG. 4, a powder supply tube 60 runs through the manifold, and acts as the backbone of the manifold assembly. Collar 65 permits gas to enter the manifold assembly through opening feature 70 and to pass through plenum 75, and to exit through orifices 80 on orifice plate 85. In this way, the gas is discharged through a plurality of orifices and will envelop the powder supply tube 60.

The gas supply 30 in FIG. 3 is divided at tee connector 90 to go to both the nozzle assembly 45, and to the supply of powder 95, and more specifically to the space above the powder, identified as 100. In the pulsed mode of operation, by pressurizing the powder source, powder begins to dispense very quickly. Without this "bias pressure", it would take several seconds for the venturi effect to develop useful powder flow. The sipper tube 110 is immersed in the powder 105 and goes through the manifold assembly and into the nozzle assembly 45.

Figure 5:
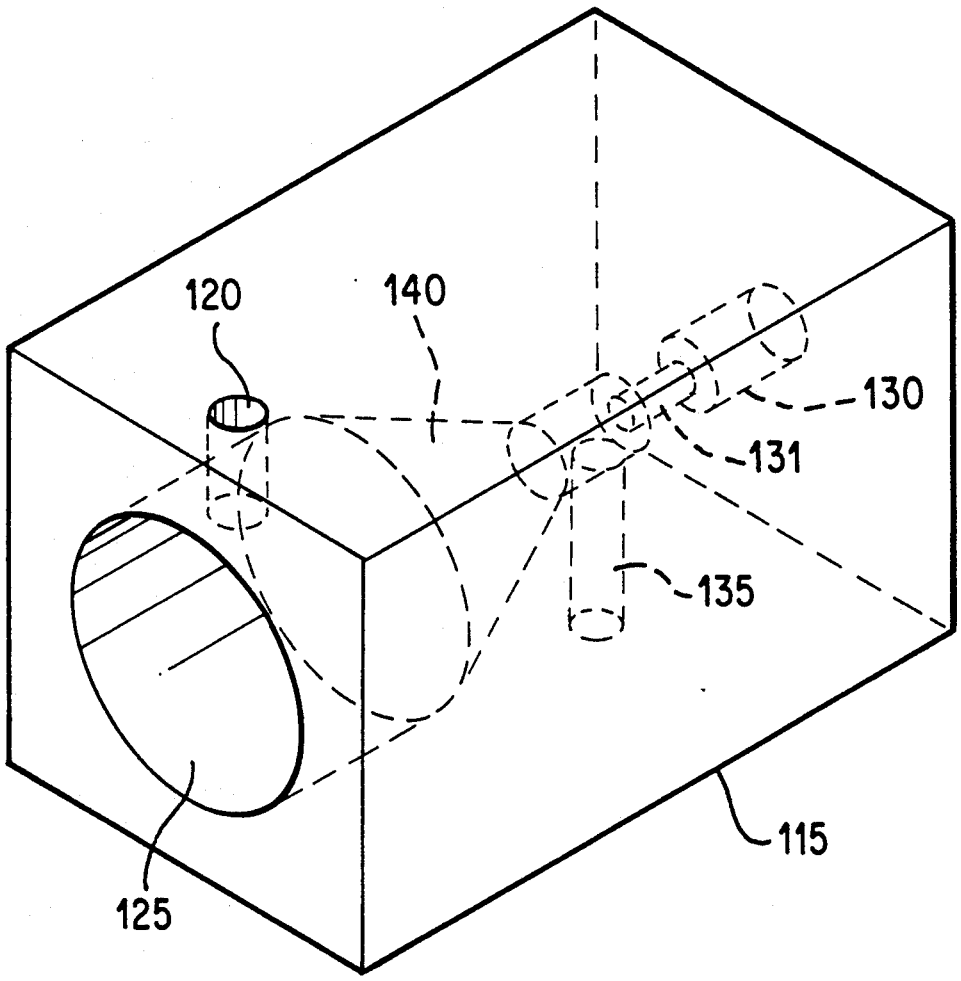
FIG. 5 is a detailed view of the nozzle housing.

FIG. 5, shows the nozzle housing 115. The supply of gas enters through cylindrical opening 120, and the manifold is installed through opening 125. The small bore cylinder to be filled will be placed into cylindrical holding feature 130, and the overflow of powder, if any, will escape through overflow conduit 135.

In use, the gas after exiting nozzle 80 is constrained to flow through a necked down venturi area 140 defined by the clearance between manifold 115 and powder supply tube 60. Because the gas velocity is high through the venturi 140, the pressure in this area is greatly reduced.

This area of low pressure draws powder 105 through sipper 110, mixes the gas with the powder, and the gas/powder mixture is discharged through the discharge port 131. In use, as shown on FIG. 3, the dispensing device having a cavity to be filled 145 is held in a holding feature 130 of nozzle housing 115.

Critical to the operation of this device is the gap G. Overflow conduit 135 allows excess gas and powdered material to escape during the fill process. In operation, the powder is packed by the velocity of the gas/powder mixture into the cavity of the dispensing device 145, but the much lower density gas is able to change direction and exit through the gap G and overflow conduit 135.

Some quantity of powder will be mixed with the overflow gas, and will be carried into the overflow collector 150. To prevent pressurizing the overflow collector 150, there is a vent to atmosphere provision 155. If the vessel 150 collecting the overflow were not vented to atmosphere, pressure would build up in the vessel. As this pressure increased, it would reach the point where the pressure used to propel the gas would equal the pressure of the overflow vessel. At this point there would be no pressure differential, and therefore no motive force. To keep the ambient environment from being contaminated by the powder being filled, there is a filter 160 in the overflow collector to keep the powder from escaping, and also to recover the powder in those applications where the powdered material is valuable.

Figure 6:
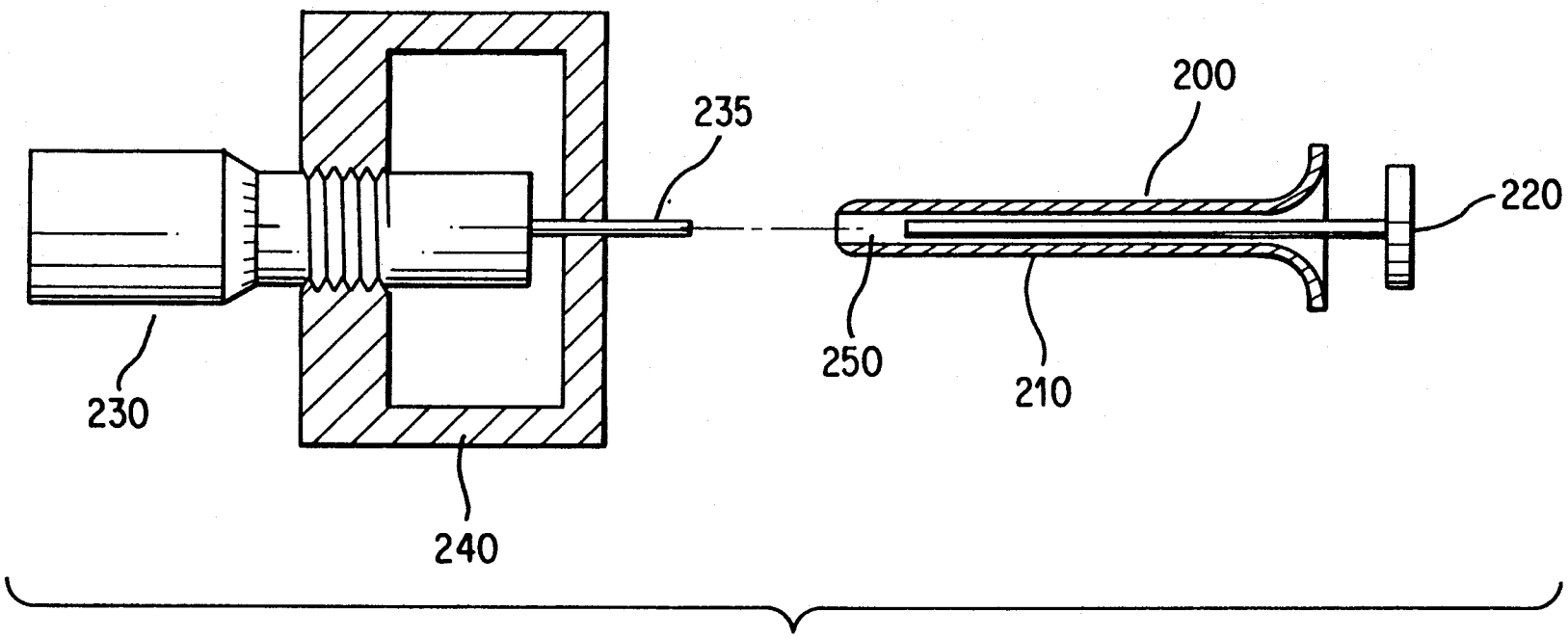
FIG. 6 depicts a dispenser which is filled with an apparatus according to the present invention.

Referring to FIG. 6, dispenser 200 is comprised of two parts, a barrel 210 and plunger 220. In a preferred embodiment, exactly 4.5 milligrams of a pharmaceutically active material is metered into the dispenser 200. Modified depth micrometer 230 is mounted into block 240 so that when the micrometer barrel is turned, attached pin 235 moves inward or outward depending on the direction of micrometer barrel rotation. Pin 235 is sized so as to fit easily into dispenser barrel 210. In use, plunger 220 is depressed, and then the dispenser assembly is impaled upon pin 235 so as to set a fixed, and repeatable position of plunger 220 in barrel 210. If the amount of material to be metered is always fixed, the micrometer adjustment need not be used, and can be replaced with a fixed length pin.

Figure 7:
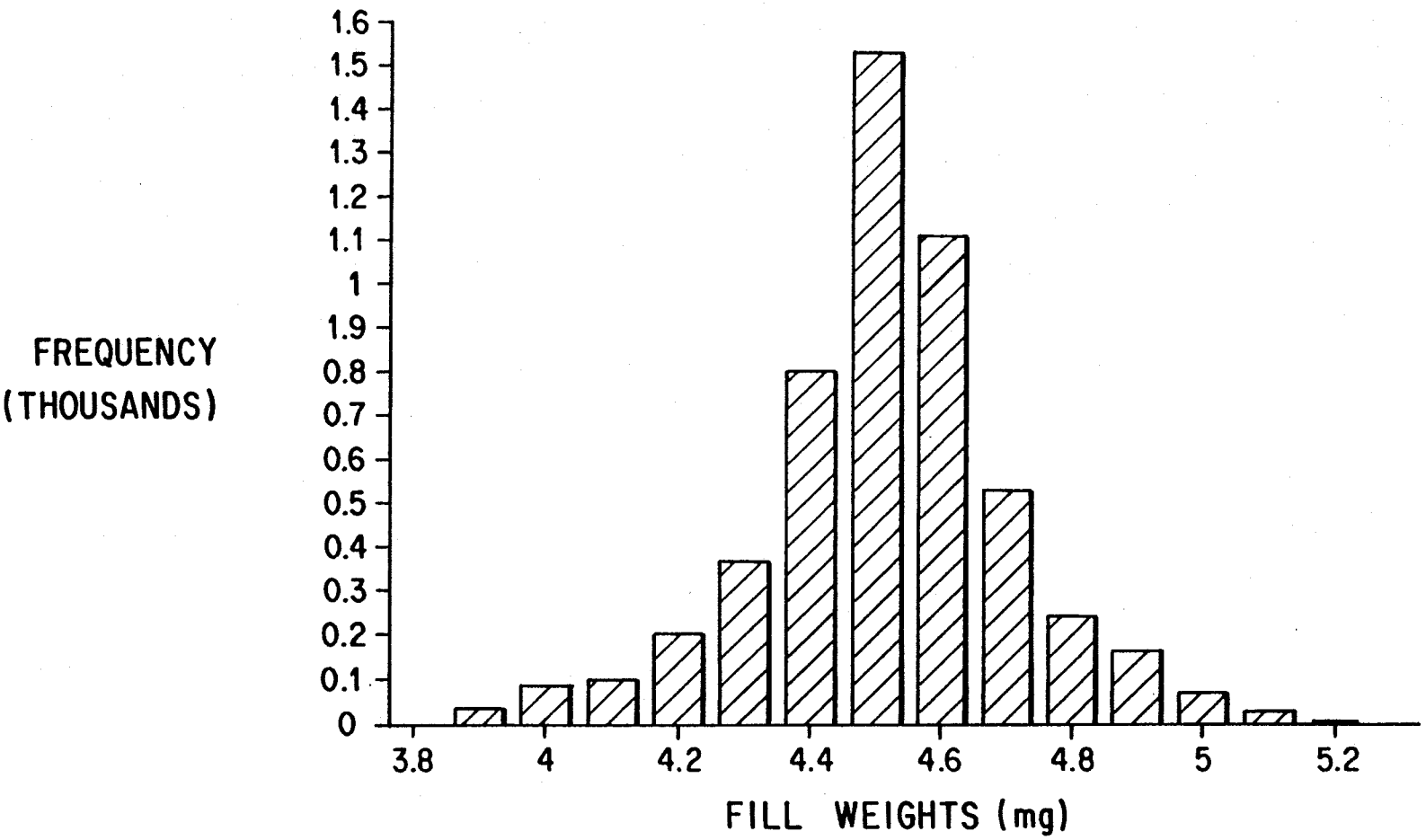
FIG. 7 shows a histogram of fill weights for a pharmaceutical powder, where the target fill weight was 4.5 milligrams.

The embodiment depicted in FIGS. 1 to 6 has been evaluated to determine if it accurately and precisely filled the cavity 250 in dispenser 200. FIG. 7, shows a typical histogram of fill weights or approximately 5400 fills.

The x-axis of the histogram shows the fill weights of 5400 periodontal dispensers filled with the antibiotic minocycline. The resultant fill weights are divided, for the purpose of presentation, into 14 bins, from 3.9 milligrams to 5.2 milligrams in 0.1 milligram increments. The y-axis of the histogram shows the number of dispensers which had the indicated fill weight.

It is apparent that the fill weights are narrowly clustered. Specifically, the average fill weight is 4.5 milligrams (which was the target fill weight), with a standard deviation of 0.19 milligrams. This 4.22 percent standard deviation is acceptable for pharmaceutical applications.

The apparatus described in this application may also be used to fill other medication delivery devices which deliver powdered inhalants to the lung. Specifically, certain medications are most effective when delivered directly to the lungs of the patient. Examples include drugs against reversible airway obstruction such as asthma, drugs to control pulmonary illnesses or infections, any drugs to fight off opportunistic infections of the lungs which tend to infect patients who have antibodies to the HIV virus (AIDS). Examples also include polypeptide products of biotechnology.

Freeze-dryed polypeptides could be delivered by the pulmonary route of administration. These rDNA products are very potent, and the required dosages are likely to be small. The subject invention is capable of accurately metering small volumes of powdered drug into a dispenser for later use.

Figure 8:
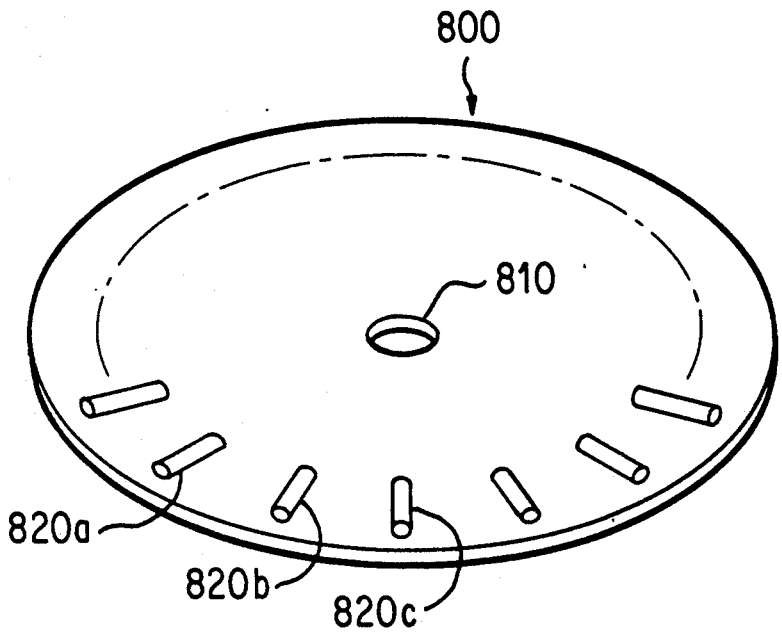
FIG. 8 depicts one embodiment of a multiple unit dose powder dispenser of the type useful for medications which can be delivered by way of oral inhalation.

FIG. 8 shows one apparatus for storing multiple-doses of powdered material and which is useful in medication delivery devices for delivery of medication to the lungs. It is comprised of a support plate 800, preferably made of plastic or paper, having a mounting feature 810, shown as a hole but which may be one of any practical holding means, and also having one or more long, thin tube-like devices 820*a* through 820*n*, for holding one or several dosages of the drug. The subject invention can be used to fill these tube like devices with drug. The devices must be made of a material which can readily be pierced or broken, so that the complete contents of one device is available for therapy. The number of such devices is a design choice, but can easily encompass from one (1) to thirty (30) dosages. The apparatus of the present invention can be used to fill one device at a time, with provision having been made to seal the filled device, and then stepping the support plate 800 to present the next position, such as 820*b* to the filling apparatus.

In the alternative it is practical to build a filling apparatus according to the present invention with multiple venturis, and multiple sources and gaps, so that all of the devices on plate 800 are filled simultaneously.

Figure 9:
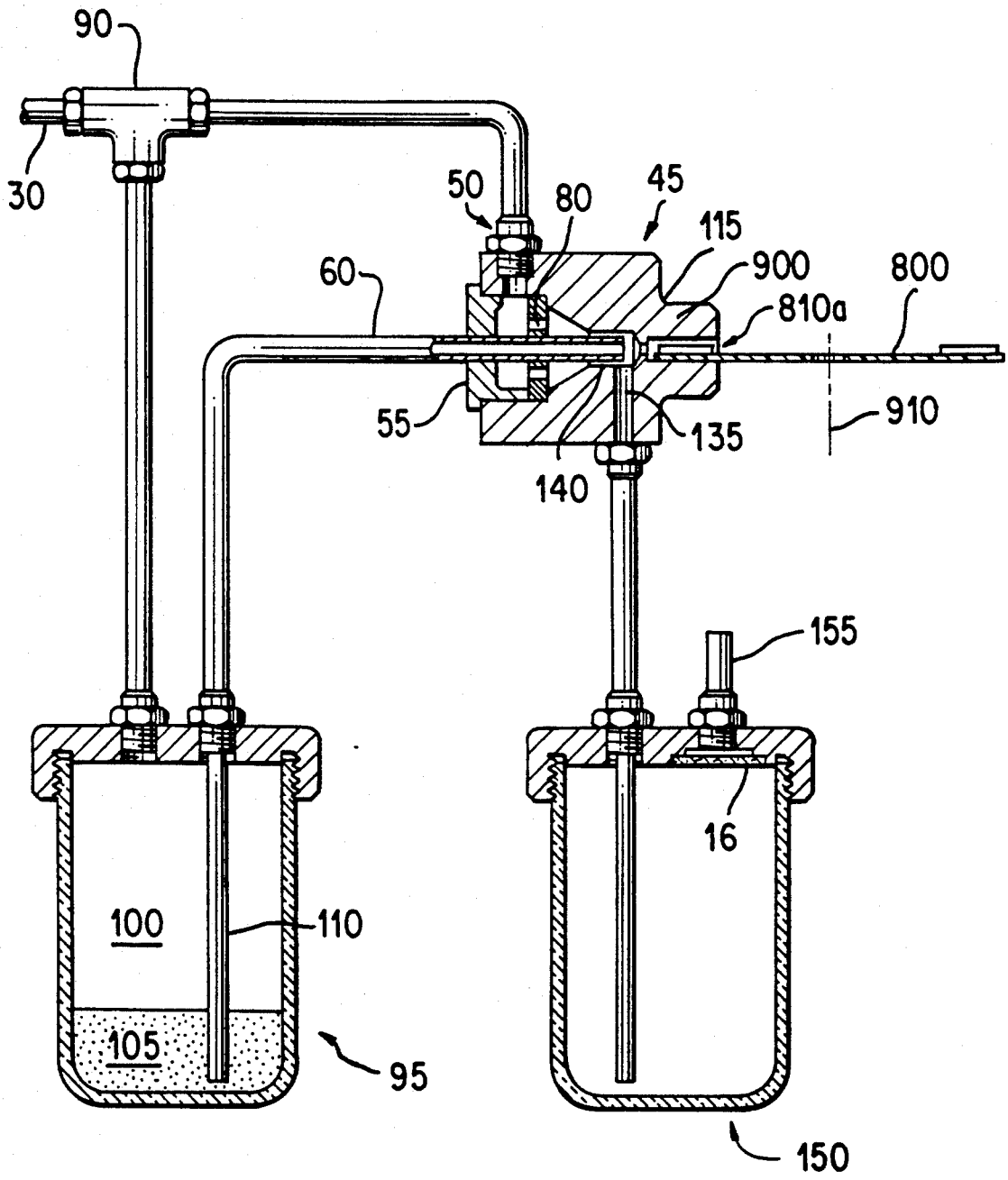
FIG. 9 depicts another embodiment of a filling apparatus according to the present invention.

FIG. 9 is a modification of FIG. 2 to the filling apparatus of FIG. 2 adapted to fill the dispenser device 820*a* instead of filling the small bore cylinder. Nozzle housing 115 is modified so that opening 130 shown in FIG. 4 is replaced by slit 900. Support plate 800 is capable of being rotated about axis 910, so as to present devices 810*a*, 810*b*, 810*c*, etc. to the discharge port.

We claim:

1. An apparatus for filling a long narrow cavity of a device containing such a cavity with a fine particulate material, which cavity having a small opening, said apparatus comprising:

(a) supply means for containing a quantity of said fine particulate material;

(b) a source of gas;

(c) means for providing a moving stream of said gas, said providing means in communication with said supply means;

(d) means for suspending said fine particulate material in said moving gas stream, said suspending means communicating with a discharge port having an orifice so that a gas stream containing suspended particulate material is discharged through the orifice of said discharge port;

(e) a housing having an aperture, said aperture defining a means for positioning the orifice of said discharge port, a gap, a means for holding said device containing the cavity to be filled and an overflow means;

(f) said discharge part having said orifice positioned within said aperture of said housing so as to point to the opening of the cavity to be filled of said device but spaced apart by said gap, said gap in communication with an overflow means, wherein upon discharge of said gas stream containing suspended particulate material through said orifice, said suspended particulate material is propelled across the gap and into the cavity to be filled until the cavity is filled to capacity with said particulate material and said gas is allowed to escape through said gap into said overflow means.

2. The apparatus of claim 1 wherein said supply means contains a supply of a fine particulate pharmaceutical composition.

3. The apparatus of claim 1 wherein said means for suspending said fine particulate material in said moving gas stream comprises a venturi in which said moving gas stream creates an area of reduced pressure which draws said particulate material and mixes it with said gas.

4. The apparatus of claim 1 also having a particulate material recovery system comprising a collection vessel pneumatically connected to said overflow means, said collection vessel having an opening which is open to atmosphere via a filter which is impervious to said particulate material.

5. The apparatus of claim 1 where said providing means comprises a timer means for allowing a pulse of gas for a period of time sufficient to fill the cavity.

6. The apparatus of claim 1 wherein said device comprises a medication dispenser.

7. The apparatus of claim 1, wherein said orifice has a width or diameter equal to or smaller than the opening of the cavity to be filled.

8. The apparatus of claim 1, wherein said gap is not more than 2 times the width or diameter of the orifice of the discharge port.

9. The apparatus according to claim 1, wherein said means for suspending said particulate material comprises a fluidized bed.

10. The apparatus according to claim 1, wherein said gas comprises air.

11. The apparatus according to claim 1, wherein said gas comprises nitrogen.

12. The apparatus according to claim 1, wherein said gas comprises carbon dioxide.

13. The apparatus according to claim 1, wherein said particulate material comprises a pharmaceutical composition.

14. The apparatus according to claim 13, wherein said pharmaceutical composition comprises minocycline.

15. An apparatus for filling encapsulated minocycline powder into a small bore diameter medication dispenser having an opening through which said powder is filled comprising:

(a) supply means for containing a quantity of said encapsulated minocycline powder;

(b) a source of a pharmaceutically acceptable dry gas;

(c) means for providing a moving stream of said gas, said providing means in communication with said supply means;

(d) venturi means for suspending said powder in said moving gas stream, said venturi means communicating with a discharge port having an orifice so that a gas stream containing suspended powder is discharged through said orifice of said discharge port;

(e) a housing having an aperture, said aperture defining a means for positioning the orifice of the discharge port, a gap, a means for holding said medication dispenser and an overflow means;

(f) said discharge port having said orifice positioned within said aperture of said housing so as to point to the opening of said dispenser to be filled but spaced apart by said gap, said gap in communication with an overflow means, wherein upon discharge of said gas stream containing suspended powder through said orifice, said powder is propelled across the gap and into the opening of the dispenser to be filled until the dispenser is filled to capacity with powder and said gas in allowed to escape through said gap into said overflow means.

16. The apparatus of claim 15 also having a particulate material recovery system comprising a collection vessel pneumatically connected to said overflow means, said collection vessel having an opening which is open to atmosphere via a filter which is impervious to said minocycline powder.

17. A method of filling a cavity of a medication dispensing device, said cavity having an opening, with a pharmacologically active powder material, which comprises:

(a) providing a supply of said powder material and a supply of pharmaceutically acceptable gas;

(b) positioning the opening of the cavity of the device to be filled so as to face an orifice through which a gas stream containing a suspended powder is discharged but spaced apart from said orifice by a gap;

(c) causing said powder to be continuously suspended in a substantially continuously moving stream of said gas and discharging said gas stream containing suspended powder through said orifice pointed at the opening of the cavity to be filled but spaced apart by said gap, wherein upon discharge of said gas stream through said orifice said powder material is propelled across the gap into the cavity to be filled until the cavity is filled to capacity with said powder and said gas is allowed to escape to the atmosphere via said gap.

18. The method of claim 17, wherein said cavity is contained in a device comprising a moveable surface to adjust the volume of said cavity.

* * * * *